United States Patent [19]

Shibuya

[11] 4,415,315

[45] Nov. 15, 1983

[54] SWASH-PLATE TYPE COMPRESSOR HAVING AN IMPROVED LUBRICANT OIL FEEDING ARRANGEMENT

[75] Inventor: Tsunenori Shibuya, Konan, Japan

[73] Assignee: Diesel Kiki Co., Ltd., Tokyo, Japan

[21] Appl. No.: 315,229

[22] Filed: Oct. 26, 1981

[30] Foreign Application Priority Data

Nov. 6, 1980 [JP] Japan ..... 55-156903

[51] Int. Cl.[3] ..... F04B 1/16; F04B 1/18

[52] U.S. Cl. ..... 417/269; 92/79

[58] Field of Search ..... 417/269; 92/79

[56] References Cited

U.S. PATENT DOCUMENTS

| | | | |
|---|---|---|---|
| 3,888,604 | 6/1975 | Oshima | 417/269 |
| 4,003,680 | 1/1977 | Nakayama | 417/269 |
| 4,005,948 | 2/1977 | Hiraga | 417/269 |
| 4,347,046 | 8/1982 | Bracken | 417/269 |

FOREIGN PATENT DOCUMENTS

| | | | |
|---|---|---|---|
| 55-48003 | 3/1980 | Japan | 417/269 |

*Primary Examiner*—William L. Freeh

*Attorney, Agent, or Firm*—Frishauf, Holtz, Goodman and Woodward

[57] ABSTRACT

In a swash-plate type compressor, a partition wall, which separates a suction passageway extending through the cylinder block and the valve plates from the swash plate chamber, has its lateral wall formed with a refrigerant gas inlet opening which communicates the suction passageway with the swash plate chamber. The refrigerant inlet opening opens in the suction passageway with its opening end directed upstream in the refrigerant gas flow in the suction passageway. The partition wall has two opposite end wall portions, at least one of which is formed with a refrigerant gas outlet opening communicating the swash plate chamber with the suction passageway.

9 Claims, 8 Drawing Figures

SWASH-PLATE TYPE COMPRESSOR HAVING AN IMPROVED LUBRICANT OIL FEEDING ARRANGEMENT

BACKGROUND OF THE INVENTION

This invention relates to a swash-plate type compressor for compressing refrigerant gas circulating in an air conditioning system, and more particularly to improvements in or to the lubricant oil feeding arrangement of the swash-plate type compressor.

In a swash-plate type compressor of this kind in general, rotation of the swash plate which is obliquely secured on the drive shaft causes reciprocating motions of the pistons within their respective cylinder bores to carry out pumping actions in cooperation with suction valves and discharge valves. The swash plate and the pistons engage each other with balls and shoes intervening therebetween in a manner that rotation of the swash plate is smoothly transduced into reciprocating motions of the pistons. According to this arrangement, the swash plate, the shoes, the balls and the pistons have their sliding contact portions subject to severe friction and therefore require to be permanently fed with lubricant oil.

Conventional lubricant oil feeding systems for feeding lubricant oil to the above sliding contact portions include a differential pressure type which is arranged such that the swash plate rotating in unison with the drive shaft splashes lubricant oil stored in the oil sump at the bottom of the cylinder block into oily mist which is fed to the above sliding contact portions and also guided to the low pressure chambers due to pressure difference between the swash plate chamber and the low pressure chambers which is caused by the reciprocating motions of the pistons within the cylinder bores, to lubricate radial bearings journalling the drive shaft, and their neighboring parts.

However, this differential pressure type has the disadvantage that there can occur a decrease in the amount of lubricant oil present within the compressor to lower the lubricant oil surface level in the oil sump so that the amount of lubricant oil splashed by the swash plate is temporarily reduced, resulting in insufficient lubrication of the aforementioned sliding contact portions and consequent seizure of these portions. Particularly, since the balls and shoes are subject to large sliding friction and fed with lubricant oil at a relatively small rate, they are more likely to seize than the other parts of the compressor such as the pistons, the cylinder bores and the radial bearings.

The reason for the aforementioned decrease in the amount of lubricant oil within the compressor is as follows: At the start of the compressor, rotation of the swash plate causes a sudden drop in the pressure within the oil sump to cause foaming of the lubricant oil so that a large amount of lubricant oil is delivered to the low pressure chambers due to the pressure difference between the swash plate and the low pressure chambers, and then sucked into the cylinder bores and discharged into the refrigerating circuit together with refrigerant gas. While circulating within the refrigerating circuit, the lubricant oil can stagnate at some places to be late in returning to the compressor. Further, refrigerant gas and lubricant oil can leak out of the refrigerating circuit, resulting in a reduced amount of refrigerant gas and lubricant oil which is returned to the compressor.

OBJECTS AND SUMMARY OF THE INVENTION

It is an object of the invention to provide a swash-plate type compressor which is provided with a lubricant oil feeding arrangement which allows direct introduction of part of lubricant oil-containing refrigerant gas into the swash plate chamber from the refrigerant gas suction passageway for separation of the lubricant oil from the refrigerant gas in the swash plate chamber, to thereby ensure positive lubrication of the swash plate, the shoes, etc. and expeditious return of the lubricant oil to the oil sump.

It is a further object of the invention to provide a swash-plate type compressor which is arranged to guide refrigerant gas from one of the low pressure chambers formed within the cylinder heads secured to the opposite ends of the cylinder block to the other low pressure chamber by way of the refrigerant gas suction passageway and the swash plate chamber, which enables forming the outer periphery of the compressor, particularly the cylinder block in a shape identical with a conventional one, to thereby facilitate installment of the compressor into a vehicle or the like.

According to the invention, there is provided a swash-plate type compressor having a partition wall which separates the swash plate chamber from a suction passageway extending through the cylinder block and the valve plates for guiding suction refrigerant gas from one of the low pressure chambers defined within cylinder heads secured to the opposite ends of the cylinder block, to the other low pressure chamber. Means is provided which defines a refrigerant gas inlet opening in the lateral wall portion of the partition wall, which communicates the suction passageway with the swash plate chamber. The refrigerant gas inlet opening has its one end opening in the suction passageway and directed upstream in a refrigerant gas flow in the suction passageway. The partition wall has two opposite end walls, at least one of which is formed with at least one refrigerant outlet opening communicating the swash plate chamber with the suction passageway.

The above and other objects, features and advantages of the invention will be more apparent from the ensuing detailed description taken in connection with the accompanying drawings in which:

DETAILED DESCRIPTION

The invention will now be described in detail with reference to the drawings in which several embodiments of the invention are illustrated.

Figure 1:
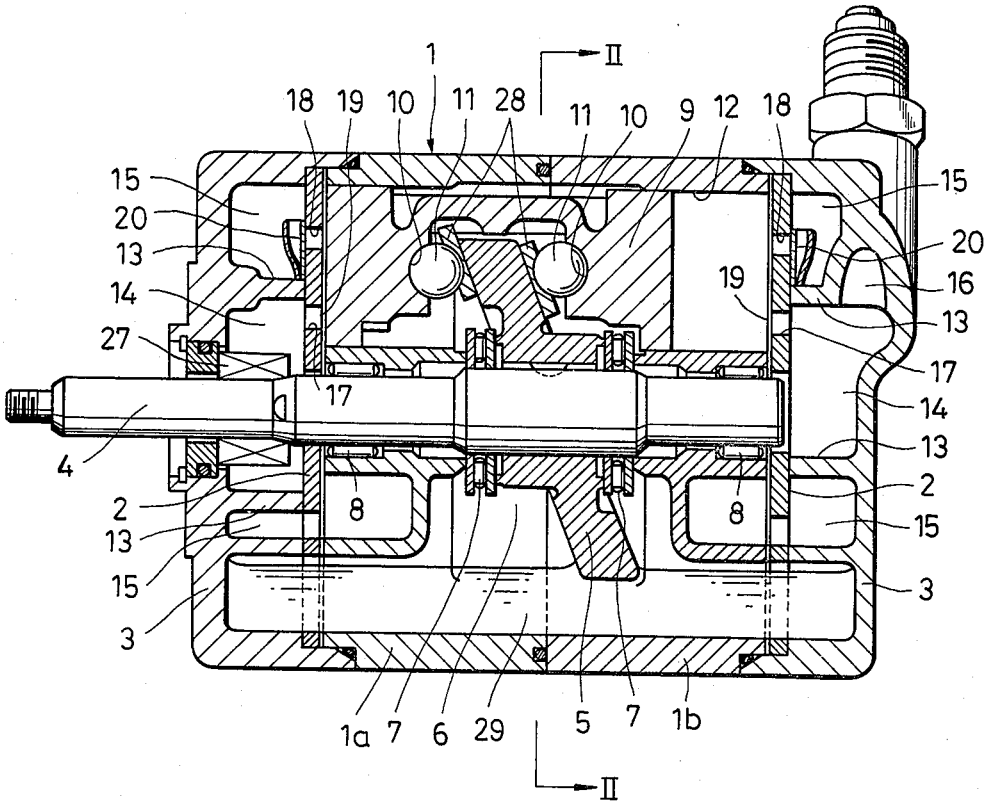
FIG. 1 is a longitudinal sectional view illustrating a swash-plate type compressor according to a first embodiment of the invention.
Figure 2:
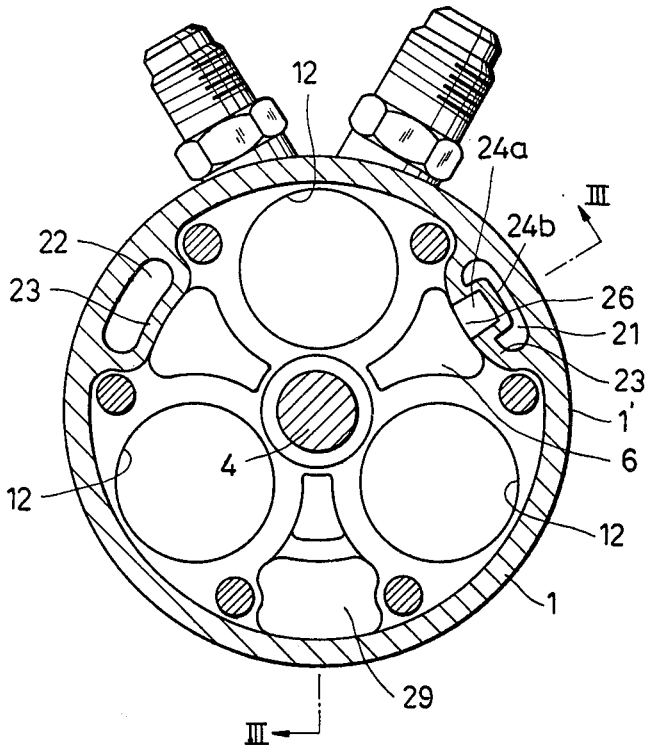
FIG. 2 is a sectional view taken along line II—II in FIG. 1, with the swash plate, the balls and the shoes omitted.
Figure 3:
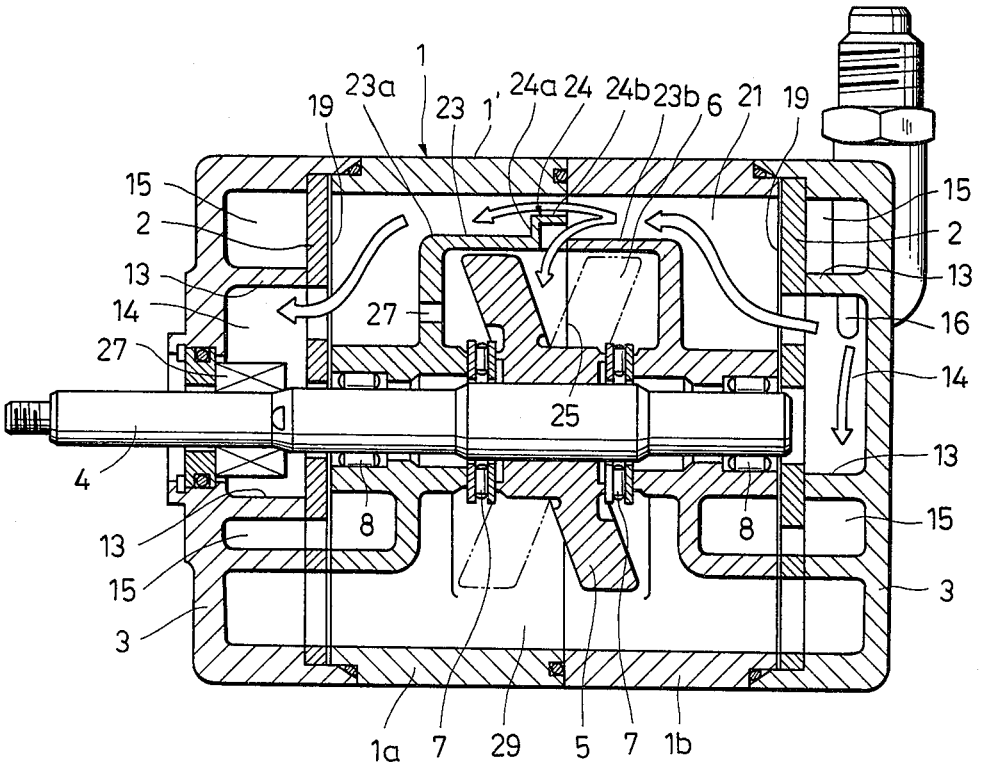
FIG. 3 is a sectional view taken along line III—III in FIG. 2.

Referring first to FIGS. 1 through 3 illustrating a first embodiment of the invention, a pair of cylindrical members 1*a*, 1*b* forming a cylinder block 1 are combined together in axial alignment, with cylinder heads 3, 3 secured to the opposite outer ends of the members 1*a*, 1*b* via valve plates 2, 2. A drive shaft 4 extends through the cylinder block 1 along its axis with its front end portion exposed to the outside, and is adapted to be driven for rotation by means of a prime mover, not shown.

A swash plate 5 is obliquely secured on the drive shaft 4 and located within a swash plate chamber 6 formed of a substantially central location in the cylinder block 1. The swash plate 5 and the drive shaft 6 are supported on thrust bearings 7, 7 and radial bearings 8, 8 for rotation relative to the cylinder block 1.

Three double-acting pistons 9 (only one of them is shown) are slidably received within three respective cylinder bores 12 (only one of them is shown) formed through the cylinder block 1 in a manner extending parallel with the drive shaft 4 and circumferentially arranged at equal intervals.

These pistons 9 each have its central portion formed with a central recess which radially inwardly opens and has semispherical ball pockets 10, 10 formed in its opposite end walls. The pistons 9 each have its central recess engaging the swash plate 5 in a manner holding it at its opposite side surfaces by means of balls 11, 11 fitted in the ball pockets 10, 10 and shoes 28, 28 engaging the balls 11, 11. Thus, when the swash plate 5 is swingingly rotated in unison with the rotating drive shaft 4, it urges the shoes 28, 28 while sliding thereagainst to cause reciprocating motions of the pistons 9 within the respective cylinder bores 12.

The cylinder bores 12 have their opposite end faces covered with the valve plates 2, 2 and their central portions communicating with the swash plate chamber 6.

The cylinder heads 3, 3 are formed therein with annular partition walls 13, 13, respectively, which divide the interiors of the respective cylinder heads into low pressure chambers 14, 14 and high pressure chambers 15, 15 which are thus located at the opposite ends of the cylinder block 1. The low pressure chamber 14 and the high pressure chamber 15 on the rear side are provided, respectively, with a suction port 16 and a discharge port, not shown, which open in the respective chambers and through which refrigerant gas with lubricant oil mixed therein in several percent (hereinafter merely called "refrigerant gas" unless otherwise defined) is sucked in from the refrigerating circuit and discharged into the same circuit, respectively. The low pressure chambers 14, 14 communicate with the cylinder bores 12, 12, 12 through suction openings 17, 17 formed through the valve plates 2, 2, while the high pressure chambers 15, 15 communicate with the same bores through discharge openings 18, 18 also formed through the valve plates 2, 2. The above suction openings 17, 17 and discharge openings 18, 18 are arranged to be closed, respectively, by suction valves 19, 19 and discharge valves 20, 20 at opposite side surfaces of the valve plates 2, 2. In this embodiment, the low pressure chamber 14 on the front side communicates with the low pressure chamber 14 on the rear side through a suction passageway 21 formed through the cylinder block 1 and the valve plates 2, 2, while the high pressure chamber 15 on the front side communicates with the high pressure chamber 15 on the rear side through a discharge passageway 22 formed through the cylinder block 1 and the valve plates 2, 2. The portions of the suction passageway 21 and discharge passageway 22 which are located within the cylinder block 1 each have its radially outer side wall defined by the outer peripheral wall 1' of the cylinder block 1 and its radially inner wall defined by a partition wall 23 formed integrally with the cylinder block 1. The partition wall 23 also serves to separate the passageway 21, 22 from the swash plate chamber 6. A sealing device 27 is arranged around the drive shaft 4 in the low pressure chamber 14 on the front side to seal the drive shaft 4 against the front cylinder head 3.

An oil reservoir 29 is formed below the swash plate chamber 6 and axially extends as far as the front and rear cylinder heads 3, 3. The swash plate 5 has its outer fringe immersed in lubricant oil stored in the oil reservoir 29.

Figure 4:
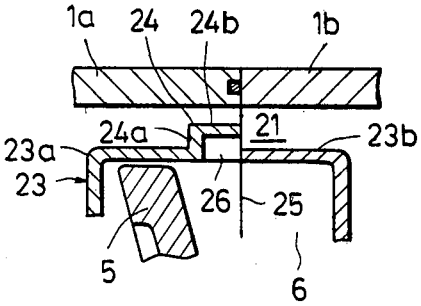
FIG. 4 is a longitudinal sectional view on an enlarged scale illustrating the essential part of the compressor of FIG. 3.

As shown in FIGS. 3 and 4, the partition wall 23 is formed of a front half portion 23*a* and a rear half portion 23*b*, both formed integrally with the front and rear cylindrical members 1*a*, 1*b*, respectively, and combined together in a manner abutting against each other in axial alignment at a substantially axially central location in the swash plate chamber 6. In the suction passageway 21, a guide wall 24 is formed on a front end portion of an axially extending lateral wall of the front half portion 23*a* and projected radially outward. This guide wall 24 is fabricated integrally with the partition wall 23 and is formed of a radial wall portion 24*a* radially outwardly extending integrally from the front end portion of the lateral wall of the front half portion 23*a* at a location slightly spaced from the abutting plane 25 between the half portions 23*a*, 23*b*, and an axial wall portion 24*b* axially extending integrally from the wall portion 24*a* and directed upstream in the refrigerant gas flow in the suction passageway 21. The radial wall portion 24*a* extends at right angles to the lateral wall portion of the partition wall 23, i.e., at right angles to the direction of flow of the refrigerant gas in the suction passageway 21. The axial wall portion 24*b* has a free end terminating in substantially the same plane with the abutting plane 25 and is located at a substantially transverse center in the portion of the suction passageway 21 between the lateral wall portion of the partition wall 23 and an associated inner wall of the cylindrical member 1*a* to divide the refrigerant gas flow into two flows. A refrigerant gas inlet opening 26 is defined by the inner surface of the guide wall 24 and an associated inner end face of the rear half portion 23*b*. This inlet opening 26 has its one end opening in the suction passageway 21 at a location between the free end of the axial wall portion 24*b* of the guide wall 24 and the associated inner end of the rear half portion 23*b* and directed upstream in the refrigerant gas flow in the suction passageway 21. The other end of the inlet opening 26 opens in a substantially axially central portion of the swash plate chamber 6 at a location between the root of the radial wall portion 24*a* and the associated inner end of the rear half portion 23*b*.

The partition wall 23 has its front end wall radially extending and formed with a refrigerant gas outlet opening 27 communicating the swash plate chamber 6 with the suction passageway 26.

With the above arrangement, as the drive shaft 4 is rotated, the swash plate 5 is swingingly rotated to cause reciprocating motions of the pistons 9 within their respective cylinder bores 12 to carry out compressing actions in cooperation with the suction valves 19, 19 and the discharge valves 20, 20. At the same time, the rotating swash plate 5 upwardly splashes the lubricant oil stored in the oil reservoir 29 to feed it to the sliding contact portions of the swash plate 15 and the shoes 28, 28, the shoes 28, 28 and the balls 11, 11, and the balls 11, 11 and the pistons 9.

The refrigerant gas is sucked into the low pressure chamber 14 on the rear side through the suction port 16 and then divided into two flows as shown by the arrows in FIG. 3 so that part of the refrigerant gas is delivered into the low pressure chamber 14 on the front side through the suction passageway 21. On the way to the chamber 14, part of the refrigerant gas flowing in the suction passageway 21 is guided into the inlet opening 26 by the axial wall portion **24*b* of the guide wall 24 as shown by the arrows in FIG. 3. The refrigerant gas thus guided into the inlet opening 26 is then collided against the radial wall portion 24*a* to be downwardly deflected and delivered into the swash plate chamber 6 at its substantially axially central portion. The refrigerant gas thus fed into the chamber 6 is collided against the opposite side surfaces of the swash plate 5 as the latter is swingingly rotated, to have its flow direction suddenly changed so that the lubricant oil is separated from the refrigerant gas and fed to the sliding contact portions of the swash plate 5, the shoes 28, 28, etc. The refrigerant gas thus being free of lubricant oil is delivered into the suction passageway 21 through the refrigerant outlet opening 27**.

By virtue of the above arrangement, a sufficient amount of lubricant oil can be positively fed to the above sliding contact portions even when there occurs a drop in the oil surface level in the oil sump 29 to such an extent that no lubricant oil is splashed by the swash plate 5, thus eliminating the possibility of seizure, etc. Further, separation of lubricant oil from refrigerant gas within the swash plate chamber 6 expedites return of lubricant oil to the oil sump 40.

In addition, the axial wall portion **24*b*, extended over the upper portion of the refrigerant gas inlet opening 26, serves to prevent the phenomenon that part of the lubricant oil splashed by the swash plate 5 passes through the inlet opening 26 into the suction passageway 21**. Therefore, the arrangement according to the invention effectively prevents escape of lubricant oil from the space defining the swash plate chamber and the oil sump together to avoid a drop in the oil surface level in the oil sump, as well as entrainment of lubricant oil into the suction refrigerant gas which leads to degeneration of the refrigerating capacity.

Figure 5:
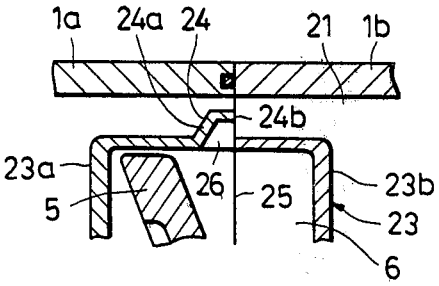
FIG. 5 is a longitudinal sectional view illustrating a swash-plate type compressor according to a second embodiment of the invention.
Figure 6:
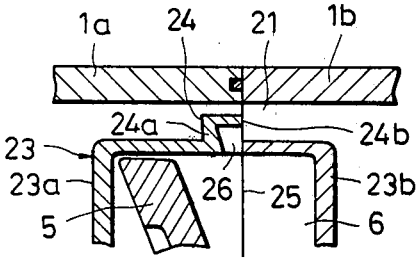
FIG. 6 is a view similar to FIG. 5, illustrating a third embodiment of the invention.
Figure 7:
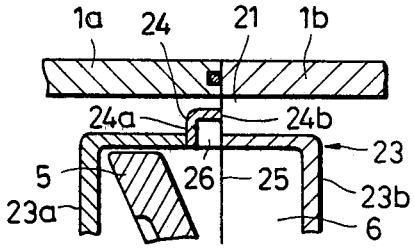
FIG. 7 is a view similar to FIG. 5, illustrating a fourth embodiment of the invention.

In view of the functions of the radial wall portion **24*a* and the refrigerant gas inlet opening 26 of guiding refrigerant gas into the swash plate chamber 6 at its axially central portion, equivalent results to those described above can be obtained from alternative arrangements illustrated in FIGS. 5 through 7. According to the arrangement in FIG. 5, the radial wall portion 24*a* of the partition wall 24 is inclined in the upstream direction in the refrigerant gas flow in the suction passageway 21. Conversely in the FIG. 6 arrangement, the radial wall portion 24*a* of the partition wall 24 is inclined in the downstream direction in the same refrigerant gas flow. According to the FIG. 7 arrangement, the guide wall 24 is fabricated in a separate piece from the partition wall 23** and joined thereto by suitable means such as welding and adhesion.

Figure 8:
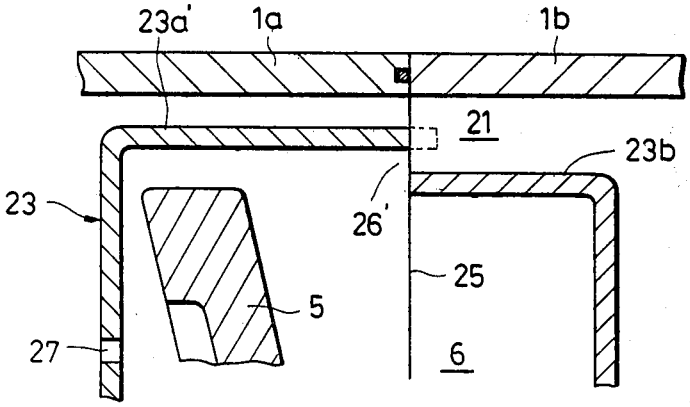
FIG. 8 is a view similar to FIG. 5, illustrating a fifth embodiment of the invention.

FIG. 8 illustrates a still further embodiment of the invention. According to this embodiment, the partition wall 23 has a front half portion **23*a*' having a radial size larger along its whole length than that of the rear half portion 23*b* so that the inner end of the front half portion 23*a*' is radially offset with respect to the opposite inner end of the rear half portion 23*b* and terminates in the same radial plane as the latter, defining a refrigerant gas inlet opening 26' between the above two inner ends, which axially opens in the suction passageway 21 in a manner facing upstream in the refrigerant gas flow. According to the FIG. 8 arrangement, in addition to equivalent results to those obtained by the arrangements of FIGS. 1 through 7, formation of the guide wall 24 is not necessary, as distinct from the preceding embodiments, facilitating working of formation of the front half portion 23*a*'. The inner end of the front half portion 23*a*' may be extended upstream in the refrigerant gas flow over the inner end of the rear half portion 23*b*, as indicated by the break line in FIG. 8, to minimize the possibility that lubricant oil splashed by the swash plate 5 passes directly into the suction passageway 21 from the swash plate chamber 6 through the inlet opening 26'**.

Incidentally, although as shown in FIGS. 3 and 8, the front end wall of the front half portion **23*a*, 23*a*' is formed with the refrigerant gas outlet opening 27, the rear end wall of the rear half portion 23*b* may be formed with a similar outlet opening in place of or in addition to the above outlet opening 27**.

Obviously many modifications and variations of the present invention are possible in the light of the above teachings. It is therefore to be understood that within the scope of the appended claims the invention may be practiced otherwise than as specifically described.

What is claimed is:

1. In a swash-plate type compressor of the type having a pair of cylindrical members joined together in axial alignment and forming a cylinder block; a pair of cylinder heads secured to opposite ends of said cylinder block, said cylinder heads having first and second low pressure chambers defined therein, respectively, said first low pressure chamber having a refrigerant gas suction port opening therein; a pair of valve plates interposed between said cylinder block and said cylinder heads; means defining a suction passageway extending through said cylinder block and said valve plates at a radially outer location in said cylinder block for guiding suction refrigerant gas containing lubricant oil from said first low pressure chamber to said second low pressure chamber; and means defining a swash plate chamber at a substantially central location in said cylinder block, said swash plate chamber accommodating a swash plate secured on a drive shaft and engaging pistons slidably received within cylinder bores of said cylinder block for causing reciprocating motions of said pistons; said suction passageway defining means and said swash plate chamber defining means including a partition wall separating said suction passageway from said swash plate chamber and having an axially extending lateral wall portion and opposite radially extending end wall portions, the improvement comprising means defining a refrigerant gas inlet opening in said lateral wall portion of said partition wall and communicating said suction passageway with said swash plate chamber, said refrigerant gas inlet opening having one end thereof opening in said suction passageway and directed upstream in a refrigerant gas flow in said suction passageway, at least one of said opposite end wall portions of said partition wall being formed with at least one refrigerant gas outlet opening communicating said swash plate chamber with said suction passageway;

said refrigerant gas inlet opening defining means comprising a guide wall having a radial wall portion extending into said suction passageway at a predetermined angle to the direction of said refrigerant gas flow in said suction passageway, and an axial wall portion axially extending integrally from said radial wall portion and directed upstream in said refrigerant gas flow, said refrigerant gas inlet opening being defined along said axial wall portion and said radial wall portion.

2. The swash-plate type compressor as claimed in claim 1, wherein said refrigerant gas inlet opening is formed in said lateral wall portion of said partition wall at a location corresponding to a substantially axially central portion of said swash plate chamber, said refrigerant gas inlet opening having another end opening in said swash plate chamber at said substantially axially central location thereof.

3. The swash-plate type compressor as claimed in claim 1, wherein said partition wall comprises first and second axially half portions combined together in axial alignment, said guide wall being provided on one of said axially half portions of said partition wall.

4. The swash-plate type compressor as claimed in claim 1, wherein said radial wall portion of said guide wall extends at substantially right angles to the direction of said refrigerant gas flow in said suction passageway.

5. The swash-plate type compressor as claimed in claim 1, wherein said radial wall portion of said guide wall is inclined upstream in said refrigerant gas flow in said suction passageway.

6. The swash-plate type compressor as claimed in claim 1, wherein said radial wall portion of said guide wall is inclined downstream in said refrigerant gas flow in said suction passageway.

7. The swash-plate type compressor as claimed in any one of claims 1, or 6, wherein said guide wall is fabricated integrally with said partition wall.

8. The swash-plate type compressor as claimed in any one of claims 1, or 6, wherein said guide wall is fabricated separately from said partition wall.

9. In a swash-plate type compressor of the type having a pair of cylindrical members joined together in axial alignment and forming a cylinder block; a pair of cylinder heads secured to opposite ends of said cylinder block, said cylinder heads having first and second low pressure chambers defined therein, respectively, said first low pressure chamber having a refrigerant gas suction port opening therein; a pair of valve plates interposed between said cylinder block and said cylinder heads; means defining a suction passageway extending through said cylinder block and said valve plates at a radially outer location in said cylinder block for guiding suction refrigerant gas containing lubricant oil from said first low pressure chamber to said second low pressure chamber; and means defining a swash plate chamber at a substantially central location in said cylinder block, said swash plate chamber accommodating a swash plate secured on a drive shaft and engaging pistons slidably received within cylinder bores of said cylinder block for causing reciprocating motions of said pistons; said suction passageway defining means and said swash plate chamber defining means including a partition wall separating said suction passageway from said swash plate chamber and having an axially extending lateral wall portion and opposite radially extending end wall portions, the improvement comprising means defining a refrigerant gas inlet opening in said lateral wall portion of said partition wall and communicating said suction passageway with said swash plate chamber, said refrigerant gas inlet opening having one end thereof opening in said suction passageway and directed upstream in a refrigerant gas flow in said suction passageway, at least one of said opposite end wall portions of said partition wall being formed with at least one refrigerant gas outlet opening communicating said swash plate chamber with said suction passageway;

said partition wall comprising first and second axially half portions combined together in axial alignment, said first axially half portion being located downstream in said refrigerant gas flow in said suction passageway and being larger in radial size than said second axially half portion such that said first and second axially half portions have opposite inner ends thereof radially offset with respect to each other to define said refrigerant gas inlet opening therebetween.

* * * * *

UNITED STATES PATENT AND TRADEMARK OFFICE

CERTIFICATE OF CORRECTION

PATENT NO. : 4,415,315

DATED : November 15, 1983

INVENTOR(S) : Tsunenori SHIBUYA

It is certified that error appears in the above-identified patent and that said Letters Patent is hereby corrected as shown below:

Column 7, line 51 (claim 7), change "claims 1, or 6," to --claims 1, 3, 4, 5 or 6,--;

Column 8, line 2 (claim 8), change "claims 1, or 6," to --claims 1, 3, 4, 5 or 6,--.

Signed and Sealed this

First Day of May 1984

[SEAL]

*Attest:*

GERALD J. MOSSINGHOFF

*Attesting Officer*

*Commissioner of Patents and Trademarks*